United States Patent [19]

Stallman

[11] 4,437,841

[45] Mar. 20, 1984

[54] OUTBOARD JET DRIVE STEERING MECHANISM

[76] Inventor: Richard C. Stallman, 1311 Dayton Ave., Alameda, Calif. 94501

[21] Appl. No.: 317,999

[22] Filed: Nov. 4, 1981

[51] Int. Cl.[3] ..... B63H 11/02

[52] U.S. Cl. ..... 440/42; 440/40; 440/46; 440/38; 60/221

[58] Field of Search ..... 440/40, 42, 46, 38; 60/221, 222

[56] References Cited

U.S. PATENT DOCUMENTS

| | | | |
|---|---|---|---|
| 3,253,567 | 5/1966 | Patton, Jr. | 440/46 |
| 3,295,490 | 1/1967 | Hiatt | 440/40 |
| 3,367,116 | 2/1968 | Stallman | 60/221 |
| 3,382,833 | 5/1968 | Wukowitz | 440/38 |
| 3,494,320 | 2/1970 | Stubblefield | 440/40 |
| 3,809,005 | 5/1974 | Rodler, Jr. | 60/221 |
| 3,903,833 | 9/1975 | Lais et al. | 440/40 |
| 4,073,257 | 2/1978 | Rodler, Jr. | 440/40 |

*Primary Examiner*—Trygve M. Blix
*Assistant Examiner*—Ivy M. Shum
*Attorney, Agent, or Firm*—Robert R. Tipton

[57] ABSTRACT

A steering apparatus for an outboard jet engine utilizes a channel or conduit along the underside of a boat hull in combination with a channel or conduit extension member to guide water to the inlet port of the jet outboard propulsion apparatus, the bottom lip of the inlet port being disposed proximate the extended bottom surface of the underside of the boat hull with the top lip or rim of the inlet port being disposed proximate the extended top surface of the channel of conduit along the hull to permit propulsion and steering of the boat while the boat hull is planing along the surface of water only inches or centimeters above the bed of the lake, river or ocean.

4 Claims, 3 Drawing Figures

OUTBOARD JET DRIVE STEERING MECHANISM

BACKGROUND OF THE INVENTION

This invention relates generally to jet outboard propulsion steering apparatus, and in particular to steering apparatus for watercraft operating in very shallow water.

On many occassions, jet outboard propelled watercraft are called upon to operate in very shallow water, approximately 1–3 inches (2 to 7 centimeters) deep, while the boat hull is planing along the surface of the water.

Where the inlet port of the jet propulsion apparatus depends downwardly to a level proximate the extended bottom surface of the boat hull, or just below, there is a strong tendency for rocks, gravel and other debris to be drawn into the inlet port of the jet propulsion apparatus in such shallow water. Where the inlet port extends below the boat hull, rocks and gravel are actually scooped up into the jet pump if the boat should run aground in shallow water. Raising the inlet port above the bottom of the boat hull removes the rock scooping problem and reduces the tendency to lift rocks and debris by suction from the bed of the river, lake or ocean. Such debris can cause jamming and serious damage to the jet drive apparatus.

If, to avoid these problems, the inlet ports of the prior art jet propelled boats were raised above the extended bottom surface of the hull, as soon as the hull of these prior art jet propelled boats started to plane along the surface of the water at high speeds, the jet propulsion apparatus would become water-starved and fail to properly propel the watercraft.

The inventors of the water jet propulsion devices of the prior art were apparently not yet confronted with these problems and, being content with having eliminated the damage prone propeller, placed the inlet port of their jet propulsion apparatus even with or below the underside of the boat hull.

Also, many of the prior art jet propulsion devices had their inlet ports disposed facing the surface of the water whereby the plane defined by the face of the inlet port was parallel to the water surface.

In some cases, the inlet port was disposed in a channel in the boat hull, however, with the inlet port having its inlet port face parallel with the surface of the water and also even with the extended bottom surface of the boat hull.

There was no indication, with respect to the prior art devices, that they were to be operated in very shallow water only inches deep, and over rocky or gravel bottoms of rivers or lakes.

Under these circumstances, shallow water operation of such prior art jet drive devices would result in rocks and debris being sucked up or drawn into the drive mechanism causing damage to the apparatus.

SUMMARY OF THE INVENTION

The steering control and propulsion apparatus for the jet outboard engine driven jet boat of the present invention comprises, basically, a boat hull having a bottom adapted to plane along the surface of the water with means defining a channel or conduit disposed along the bottom of the boat hull beginning proximate the stern of the hull and extending longitudinally forward along the hull, with the inlet port of the jet propulsion apparatus having its upper lip or rim disposed proximate the extended upper surface of said channel or conduit and its lower lip or rim disposed proximate the extended bottom surface of the hull with a means for extending the channel or conduit sternward to partially enclose the inlet port.

It is, therefore, an object of the present invention to provide a steering control for an outboard jet propulsion apparatus for a watercraft.

It is a further object of the present invention to provide a steering control apparatus for a jet outboard engine driven watercraft for operation in very shallow water.

It is another object of the present invention to provide a steering apparatus for a jet outboard engine driven boat in which steering control is maintained in very shallow (inches or centimeters deep) water.

It is still another object of the present invention to provide a steering control apparatus for a jet outboard engine driven boat for use in very shallow water without scooping up rocks, sand and other debris from the lake or river bottom.

It is a further object of the present invention to provide a steering control apparatus for a jet outboard engine driven boat in which turning maneuvers can be achieved while planing across the surface of the water without entraining air into the inlet water to the jet drive apparatus.

These and other objects of the present invention will become manifest upon study of the following detailed description when taken together with the drawings.

DESCRIPTION OF THE PREFERRED EMBODIMENT

Figure 1:
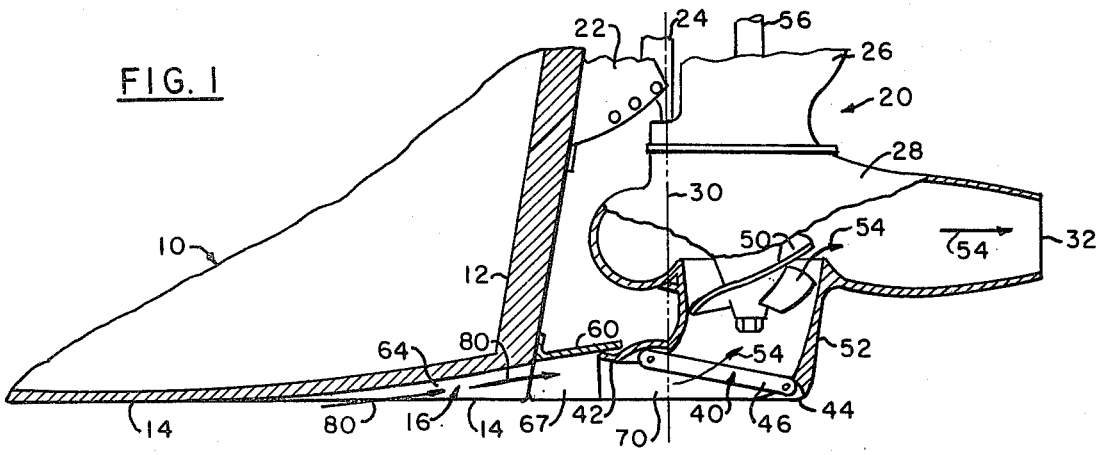
FIG. 1 is an elevational side view partial section of the jet boat steering control apparatus, of the present invention taken at lines 1—1 of FIG. 2.

With reference to FIG. 1, the steering control apparatus for an outboard engine driven jet boat comprises, basically, a boat hull 10 having a stern transom 12 and a hull bottom 14 in which is disposed a conduit or channel 16 beginning proximate the stern transom 12 of said hull and extending longitudinally forward in said hull.

Attached to transom 12 is jet outboard propulsion apparatus 20 comprising, basically, a transom support 22 attached to a pivot member 24 permitting shaft housing 26 and jet pump 28 to rotate about vertical axis 30 thereby permitting jet outlet port 32 to rotate and thus permit the output jet to steer the boat.

Jet pump 28 comprises, basically, an inlet port 40 having an upper lip or rim 42 and a lower lip or rim 44. A grating 46 is provided between upper lip 42 and lower lip 44 to prevent large particles of debris from entering the pump mechanism.

Pumping action is provided by impeller 50 inside housing 52 which draws water up through grating 46, as shown in arrow 54 and out through jet outlet nozzle 32.

An outboard engine (not shown), common in the art, is mounted above shaft housing 26 and provides the motive power through shaft 56 to drive impeller 50.

Figure 2:
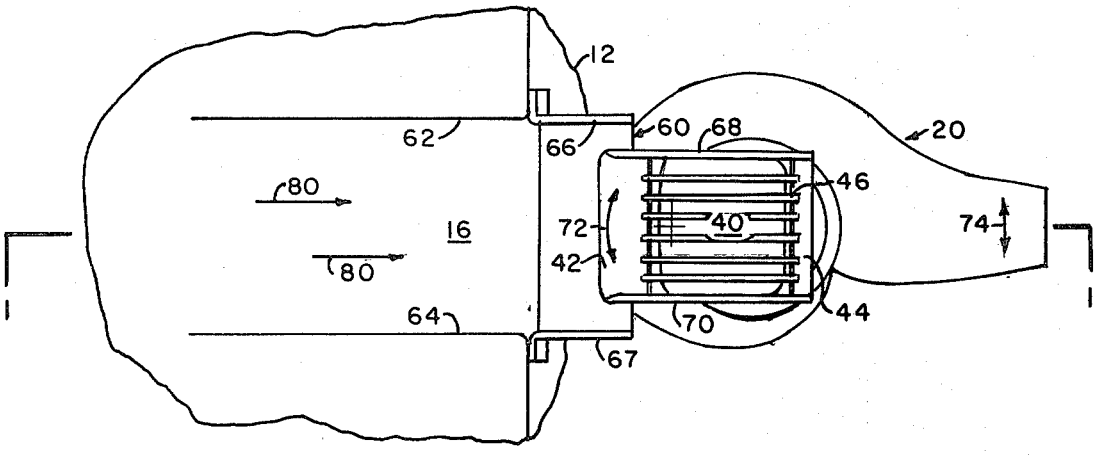
FIG. 2 is a bottom view of the jet boat steering control apparatus of the present invention.

With reference to FIG. 2, there is shown a bottom a view of the boat and propulsion apparatus comprising boat hull 10 with hull bottom 14 containing channel of conduit 16. Jet outboard propulsion apparatus 20 is disposed sternward of hull 10 and stern transom 12.

To provide a continuous flow of water from channel or conduit 16 to inlet port 40, a conduit extension member 60 is provided attached to transom 12 and extending along the upper side of conduit 16 and around port side 62 and starboard side 64 of conduit 16.

Conduit extension member 60 further comprises a pair of depending side skirts or barriers 66 and 67 (port side skirt 66 and starboard side skirt 67) to act as extended portions of conduit sides 62 and 64, respectively.

Thus upper lip 42 of inlet port 40 is disposed proximate the extended top surface of conduit 16 partially enclosed by conduit extension member 60. Lower lip or rim 44 is disposed proximate the extended bottom surface 14 of hull 10. It can be seen that inlet port 40 also comprises a port side member or skirt 68 and a starboard side member or skirt 70 to further direct water into inlet port 40.

It can be seen in FIG. 2 that the width of conduit extension 60 is arranged to be somewhat wider than inlet port 40 and side skirts 68 and 70 to permit rotation of outboard propulsion apparatus 20 about axis 30 (FIG. 1), as shown by arrows 72 and 74 (FIG. 2). This permits upper lip 42, which is disposed within the surrounding end of conduit extension 60 and depending side skirts 66 and 67 to gather water flowing through conduit 60.

Figure 3:
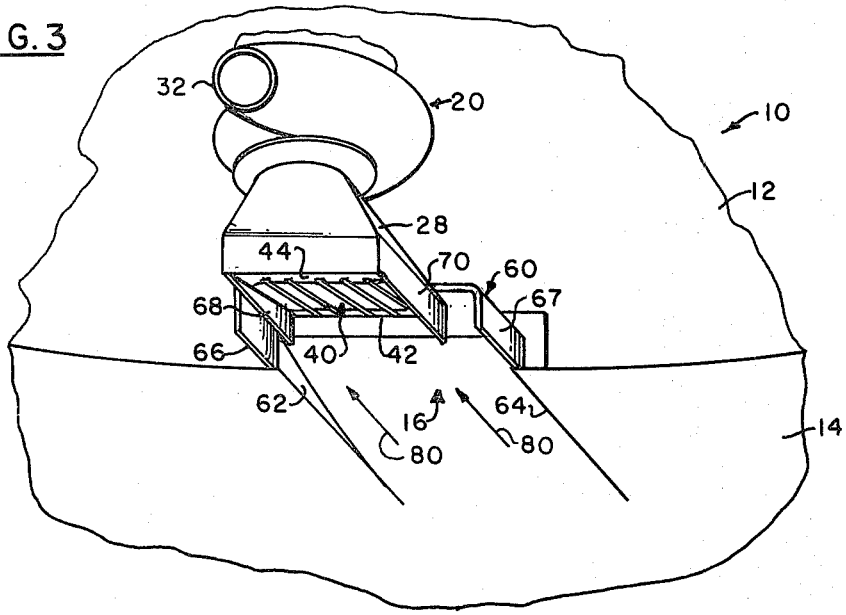
FIG. 3 is an isometric view of the jet boat steering control apparatus of the present invention looking up from below the stern toward the bow of the boat.

With reference to FIG. 3, there is illustrated an isometric view of the steering apparatus of FIGS. 1 and 2 viewed from below the stern. It can be seen in FIG. 3 how conduit extension 60 is arranged relative to conduit 16 and upper lip or rim 42 of inlet port 40.

It must be noted that conduit extension member 60 side skirts 66 and 67. as well as inlet port 40 side skirts 68 and 70, are vitally important to guide water into inlet port 40. When a turning maneuver is executed, the bottom of hull 14 will tend to skid sideways across the surface of the water. If conduit extension member 60 side skirts 66 and 67 were missing, air would be entrained in the water exiting out of conduit 60 by virtue of the sideways skidding motion causing the water to be deflected away from inlet port 40. This entrained air would substantially reduce the propulsion capability of jet propulsion apparatus 20.

With conduit extension member 60 side skirts 66 and 67 in place, as shown, as well as inlet port 40 side skirts 68 and 70 arranged as shown, no air will be entrained in the water flowing into inlet port 40, thus maintaining maneuverability of the water craft while planing along the surface of the water.

Instead of a groove or conduit formed into bottom 14 of boat hull 10, a pair of port and starboard filler members (not shown) can be attached, spaced apart, along the hull bottom to also define conduit 16 therebetween in order to adapt an existing hull to use the steering control apparatus of the present invention.

To operate the steering control apparatus of the present invention, the boat hull is propelled by jet outboard apparatus 20 across the water a speed whereby hull bottom 14 is planing along the surface of the water from the forward portion of the hull to the stern.

In so doing, water will have a tendency to pass up through conduit 16 and be directed toward inlet port 40 of outboard propulsion apparatus 20, as shown by arrows 80 (FIGS. 1 an 2), to be guided by sides 62 and 64 of conduit 16 and side skirts 66 and 67 of conduit extension 60. In this planing condition, lower lip 44 of jet outboard propulsion apparatus 20 is arranged to be even with the extended surface of bottom 14 of hull 10.

When encountering very shallow water (inches or centimeters deep), hull bottom 14 will tend to plane over the surface of the water, however, permitting water to pass up through conduit 16 in order to provide continuing propulsion and feed water to jet pump 28.

Should hull bottom 14 come within one inch or so of contacting the bed of the lake or river, there will still be a sufficient amount of water passing through conduit 16 to provide water for propulsion.

When executing a turn, jet outboard propulsion apparatus 20 is rotated about pivot 30 permitting rotation as shown in FIG. 2 by arrows 72 and 74 either to the right or to the left. Because of its position, being enclosed by conduit extension 60 and side skirts 66 and 67, water will be continually provided to inlet port 40. In addition, water will be guided to inlet port 40 through the use of side skirts 68 and 70 on each side of inlet port 40.

While planing through a turn, as the boat hull slides sideways on the surface of the water, skirts 66, 67, 68 and 70 prevent the side entry of air into jet pump inlet port 40 and thus prevents thrust loss and/or engine overspeed and resulting loss of control.

Thus, as boat hull 10 planes across the water, having both forward motion and some side skidding motion, water will continue to flow into inlet port 40 even though inlet port 40 and hull bottom 14 are only inches or centimeters above the river or lake bottom. Thus, side portions 62 and 64 of conduit 16, and skirts 66 and 67 of conduit extension 60, in cooperation with side skirts 68 and 70 of inlet port 40, all combine to guide water into inlet port 40 to provide continued propulsion in extremely shallow water.

I claim:

1. A steering control apparatus for an outboard engine driven jet boat comprising a boat hull having a bottom adapted to plane along the surface of the water, a jet outboard propulsion apparatus having means defining a water inlet port and means defining a water outlet port, said water inlet port having an upper lip and a lower lip, means defining a conduit disposed along said hull beginning proximate the stern of said hull and extending longitudinally forward in said hull, said upper lip of said water inlet port disposed proximate the extended upper surface of said conduit, and said lower lip of said water inlet port disposed proximate the extended bottom surface of said hull, means for extending said conduit sternward proximate said inlet port comprising a channel top member having a pair of side skirts depending downwardly therefrom to partially enclose said upper lip of said inlet port, and means for preventing entrainment of air into said inlet port during a turning maneuver of said jet boat.

2. The steering control apparatus for an outboard engine driven jet boat as claimed in claim 1 wherein said means for preventing entrainment of air into said inlet port during a turning maneuver of said jet boat comprises a pair of side skirts depending downwardly proximate the port and starboard rims of said inlet port whereby water is directed to said inlet port.

3. A steering control apparatus for an outboard engine driven jet boat comprising a boat hull having a bottom adapted to plane along the surface of the water, a jet outboard propulsion apparatus having means defining a water inlet port and means defining a water outlet port, said water inlet port having an upper lip and a lower lip, means defining a channel having a top and sides disposed along said boat hull beginning proximate the stern of said hull and extending longitudinally forward along said hull, said upper lip of said water inlet port disposed proximate the extended top surface of said channel, and said lower lip of said water inlet port disposed proximate the extended bottom surface of said boat hull, means for extending said channel sternward proximate said water inlet port comprising a pair of port and starboard side skirts depending downwardly from the respective port and starboard side of said means for extending said channel sternward to partially enclosed the forward portion of said water inlet port, and means for preventing air from being entrained in water flowing into said inlet port during a turning maneuver of said boat comprising a pair of port and starboard side skirts depending downwardly along the respective port and starboard sides of said inlet port.

4. A steering control apparatus for an outboard engine driven jet boat comprising a boat hull having a bottom adapted to plane along the surface of the water, a jet outboard propulsion apparatus having means defining a water inlet port and means defining water outlet port, said water inlet port having an upper and a lower lip, said jet outboard propulsion apparatus adapted to rotate about a vertical axis, means defining a channel having a top and sides disposed along said boat hull beginning proximate the stern of said hull and extending longitudinally forward along said hull, said upper lip of said water inlet port disposed proximate the extended top surface of said channel, and said lower lip of said inlet port disposed proximate the extended bottom surface of said hull, a pair of port and starboard skirts adapted to depend downwardly from the respective port and starboard sides of said water inlet port to a level proximate said lower lip of said inlet port, and means for extending said channel sternward proximate said water inlet port to partially enclose said inlet port for all angles of rotation of said jet outboard propulsion apparatus about said vertical axis.

* * * * *